US011835223B2

(12) United States Patent
Gantenbrink

(10) Patent No.: US 11,835,223 B2
(45) Date of Patent: Dec. 5, 2023

(54) LUMINAIRE FOR GENERATING DIRECT LIGHTING AND INDIRECT LIGHTING

(71) Applicant: BEGA Gantenbrink-Leuchten KG, Menden (DE)

(72) Inventor: Heinrich Johannes Gantenbrink, Menden (DE)

(73) Assignee: BEGA Gantenbrink-Leuchten KG, Menden (DE)

( * ) Notice: Subject to any disclaimer, the term of this patent is extended or adjusted under 35 U.S.C. 154(b) by 0 days.

(21) Appl. No.: 18/024,259

(22) PCT Filed: Sep. 2, 2021

(86) PCT No.: PCT/EP2021/074200
§ 371 (c)(1),
(2) Date: Mar. 1, 2023

(87) PCT Pub. No.: WO2022/049167
PCT Pub. Date: Mar. 10, 2022

(65) Prior Publication Data

US 2023/0265988 A1 Aug. 24, 2023

(30) Foreign Application Priority Data

Sep. 2, 2020 (LU) ..... 102029

(51) Int. Cl.
*F21V 7/00* (2006.01)
*F21S 4/28* (2016.01)
(Continued)

(52) U.S. Cl.
CPC ..... *F21V 7/0016* (2013.01); *F21S 4/28* (2016.01); *F21V 7/0083* (2013.01); *F21S 8/026* (2013.01);
(Continued)

(58) Field of Classification Search
CPC ..... F21V 7/0016; F21V 7/0083; F21S 4/28; F21S 8/026; F21Y 2103/10
See application file for complete search history.

(56) References Cited

U.S. PATENT DOCUMENTS 6,843,586 B1 * 1/2005 Allaire ..... F21V 17/102 362/147
9,494,293 B2 * 11/2016 Pickard ..... F21V 5/04
(Continued)

FOREIGN PATENT DOCUMENTS

DE 29620583 U1 2/1997

*Primary Examiner* — Thomas M Sember
(74) *Attorney, Agent, or Firm* — Smartpat PLC

(57) ABSTRACT

A luminaire comprises a first light exit opening for emitting light from at least two light sources. A diffusely-reflecting first reflector portion is arranged on an inner side of a luminaire body. A first light source is arranged in an edge portion of the luminaire body surrounding the first light exit opening. First light beams of the first light source are deflected towards the first reflector portion by a second reflector portion, so that said beams exit through the first light exit opening as a diffusely-reflected first light beam bundle. A second light source generates a second light beam bundle. The first light beams exit the luminaire body exclusively as first light beams reflected at the first reflector portion. A second light exit opening is surrounded by the first reflector portion. A second aperture angle of the second light beam bundle is smaller than the first aperture angle.

15 Claims, 1 Drawing Sheet

(51) Int. Cl.

| | |
|---|---|
| ***F21Y 103/10*** | (2016.01) |
| ***F21Y 115/10*** | (2016.01) |
| ***F21S 8/02*** | (2006.01) |

(52) U.S. Cl.
CPC ..... *F21Y 2103/10* (2016.08); *F21Y 2115/10* (2016.08)

(56) References Cited

U.S. PATENT DOCUMENTS

| | | | | |
|---|---|---|---|---|
| 9,512,977 | B2 * | 12/2016 | Pickard | F21V 7/0066 |
| 10,203,088 | B2 * | 2/2019 | Lay | F21V 13/04 |
| 2010/0079087 | A1 | 4/2010 | Watanabe et al. | |
| 2014/0036509 | A1 | 2/2014 | Hong et al. | |

* cited by examiner

LUMINAIRE FOR GENERATING DIRECT LIGHTING AND INDIRECT LIGHTING

CROSS-REFERENCE TO RELATED APPLICATION

This application is a national stage application, filed under 35 U.S.C. § 371, of International Patent Application No. PCT/EP2021/074200, filed on 2021 Sep. 2, which claims the benefit of Luxembourg Patent Application No. 102029, filed 2020 Sep. 2.

TECHNICAL FIELD

The invention relates to a luminaire for creating a direct and an indirect illumination.

BACKGROUND

Indirect lighting is usually used for lighting that is perceived as comfortable. With indirect lighting, an impression of natural ambient light is created depending on the set luminous intensity and depending on the set, preferably warm color temperature of the light rays. By a diffuse reflection of the light rays, a wide and planar light discharge from the lamp with soft light transitions and soft shadows can be created.

To create a productive working atmosphere at a workstation, such as a desk, the workstation should advantageously be illuminated by direct lighting with light beams that are as bright as possible. Direct lighting can be provided, in particular, by lighting with directional light beams. In addition, to promote a productive working atmosphere, a bright light should be selected in conjunction with a cool color temperature.

Luminaires for combined direct and indirect illumination of a room or a useful area are known from the prior art. For this purpose, various light sources arranged within a luminaire housing or on a luminaire housing are usually provided, through which either direct illumination or indirect illumination takes place. Indirect illumination is usually achieved by light rays of a lamp first impinging on and being reflected by a diffusely-reflecting reflector screen, and then impinging on the surface to be illuminated as diffusely-scattered light rays from the luminaire. Direct illumination can be produced by directed light beams, wherein reflectors or lenses are used to concentrate or focus the light beams in order to thus produce high light intensity on the surface to be illuminated within a relatively small areal extent. For a particularly pleasant lighting atmosphere due to the indirect lighting component in combined direct and indirect lighting, it is essential that the luminaire does not cause any dazzling effect when looking towards or into the luminaire body. Luminaires for direct and indirect illumination are known from the prior art, wherein the light rays emitted by a light source arranged within the luminaire body are deflected in the direction of a diffusely-reflecting lamp shade by means of mirrors. The mirrors comprise a reflective surface which points at least partially in the direction of the light exit opening of the luminaire body. As a result, when looking in the direction of the luminaire body, the indirect lighting component of the light rays deflected by the mirrors is perceived as disturbing and dazzling. In addition, the visibility of the mirrors severely limits the aesthetic design of such luminaires.

In lighting technology, the term half-peak-divergence is used to describe the radiation characteristics of luminaires.

The half-peak-divergence is also referred to as the beam angle, half-value angle or aperture angle and is a value used in lighting technology to describe an angle of radiation. The half-peak-divergence is used to describe a metrologically relevant range of light rays within which the luminous intensity is reduced to half the maximum value of the luminous intensity. According to DIN 5040, a light cone with a half-peak-divergence of up to 10 degrees is described as narrow-beamed, between 10 degrees and 35 degrees as bundling or scattering, and greater than or equal to 35 degrees as wide-beamed. Depending on the configuration of the luminaire, for example when reflectors, lenses or apertures are used, depending on the configuration of the illuminant and depending on the distance of the luminaire to the ground or to the illuminated object, the size of the illuminated area is changed.

In the following, the term aperture angle is used to describe the angle of the light rays extending in an edge region within a light beam bundle. It is generally assumed that the light beam bundle diverges in the direction of light beam propagation so that, starting from the light source, a light cone is generally formed. Depending on the configuration of the reflectors of the luminaire, for example in the case of a non-rotationally symmetrical reflector arrangement of the luminaire, the aperture angle can have different values in different spatial directions, whereas the aperture angle in a luminaire with a rotationally symmetrical reflector design is the same in all directions perpendicular to the light beam propagation direction.

SUMMARY

It is considered to be the object of the present disclosure to provide a luminaire with which a particularly convenient lighting situation is possible with both direct and indirect lighting components.

The luminaire has a half-shell-shaped luminaire body. The luminaire body comprises a first light exit opening for emitting light from at least two light sources of the luminaire. The luminaire body comprises a diffusely-reflecting first reflector portion on an inner side. A first light source is arranged inside the luminaire body in an edge portion of the luminaire body surrounding the first light exit opening. First light rays of the first light source are at least partially deflected in the direction of the first reflector portion by a second reflector portion arranged within the luminaire body and exit from the luminaire body through the first light exit opening as a first light beam bundle diffusely-reflected at the first reflector portion. A second light source is arranged at least in sections within the luminaire body and wherein a second light beam bundle directed in the direction of the first light exit opening can be generated by the second light source. The luminaire body comprises in the edge portion a light-impermeable cover part surrounding the first light exit opening. The second reflector portion is arranged at least in sections on the cover part. The cover part is configured such that the first light beams exit from the luminaire body through the first light exit opening exclusively as a first light beam bundle reflected at the first reflector portion.

The luminaire body comprises a second light exit opening which is surrounded at least in sections by the first reflector portion. Due to the fact that the first light beam bundle exiting from the first light exit opening is diffusely-reflected, a particularly soft and pleasant indirect illumination can be produced. As a result, a shadow cast by the first light beam bundle can be perceived as particularly soft, so that a pleasant lighting situation can be generated on the surface to be illuminated. Since the cover part prevents the first light beams that are not reflected at the first reflector portion from escaping from the luminaire body, glare of an observer by the first light beams is prevented.

In order to create a particularly convenient lighting situation, an advantageous embodiment provides that the second light beam bundle is completely enclosed by the first light beam bundle outside the luminaire body. This can be achieved, for example, in that two light beam bundles generated by two different light sources, which, for example, have the same aperture angle as a light beam cone, are arranged one behind the other in the direction of light beam propagation.

In order to achieve in a particularly simple manner that the second aperture angle is smaller than the first aperture angle, it is provided in an advantageous implementation that the second light beam bundles generated by the second light source are shaded at a circumferential edge of the second light exit opening, whereby the second aperture angle is smaller than the first aperture angle.

In order to generate a particularly small aperture angle of the second light beam bundle, in an advantageous embodiment, it is provided that the second light source is arranged set back behind the second light exit opening against a beam propagation direction of the second light beam bundle. The further the second light source is set back behind the second light exit opening, the smaller the aperture angle of the second light beam bundle can be set. A smallest possible aperture angle results from the diameter of the circumferential edge of the second light exit opening pointing in the direction of the luminaire body.

In order to make the direct illumination by the second light beams and the indirect illumination by the diffusely-reflected light beams particularly soft and pleasant when they are superimposed, it is provided that a diameter of the second light exit opening is preferably at most one fifth, preferably at most one tenth or particularly preferably at most one twentieth of a diameter of the first light exit opening. Due to a small dimension of the second light exit opening compared to the dimension of the first light exit opening, the inside of the luminaire body is perceived as particularly wide and deep when looking into the luminaire body.

In order that a spatially limited direct illumination of the working area can be implemented, it is provided in an advantageous embodiment that the second light source comprises a beam-shaping element, by means of which a second aperture angle of the second light beam can be adjusted. In this case, the beam-shaping element can be configured as a reflector concentrating the second light beam bundle, wherein the reflecting side of the reflector is oriented in the direction of the second beam exit opening and the first beam exit opening. Alternatively, the bundling of the second light beam bundle can be performed by a bundling lens arrangement, wherein the second light beam bundle is directed and bundled in the direction of the first light exit opening.

In order to produce particularly good direct illumination on the work surface with simultaneous superimposition of indirect illumination, in an advantageous embodiment it is provided that by means of the beam-shaping element the second aperture angle of the second light beam bundle passing through from the first light exit opening and the second light exit opening can be set smaller than a first aperture angle of the first light beam bundle passing through from the first light exit opening.

In order to be able to adapt an illumination situation to the required or desired illumination situation, it is provided that a light intensity of the first light beam bundle and a light intensity of the second light beam bundle are adjustable independently of one another.

In order that glare from the first light beams can be particularly well prevented, it is provided in an advantageous embodiment of the luminaire that the cover part and the second reflector portion are arranged at least in sections between the first light source and the first light exit opening. A direct view into the first light source or into a possibly dazzling second reflector portion is prevented.

In order to redirect the first light rays emitted in the direction of the first light exit opening particularly well in the direction of the first reflector portion, it is provided in an advantageous implementation that the second reflector portion is arranged on a side of the cover part facing away from the first light exit opening and facing the inner side of the luminaire body.

In order to enable complete deflection of the first light rays emitted in the direction of the first light exit opening in the direction of the first reflector portion, the luminaire can advantageously also be designed in such a way that the second reflector portion completely surrounds the first light exit opening.

In an advantageous embodiment of the luminaire, it is provided that the luminaire body is formed as a hemisphere. Alternatively, the luminaire body can also consist of a body of rotation, which results from a rotation of a half ellipse about a vertical axis of the ellipse. It is also conceivable that the luminaire body is also formed by a so-called half torus. A torus is a body of rotation formed by rotating a circle about an axis located in the plane of the circle, the distance of the axis of rotation from the center of the circle being at least equal to the diameter of the circle. Due to a continuously extending inner surface of such designed luminaire bodies, the illuminance distribution of the light rays exiting the luminaire is perceived as very uniform. In combination with a uniformly monochromatic coating of the inner side of the luminaire body and an absence of geometric elements interrupting the uniform inner surface of the luminaire body, such as edges, folds or creases, the illuminance distribution of the first light rays reflected by the first reflector portion is perceived as particularly uniform.

In order to prevent the first light beams from exiting in a particularly simple manner, it is provided in an advantageous embodiment of the luminaire that the cover part is L-shaped, wherein a first leg of the L-shaped cover part adjoins an edge of the luminaire body and extends in the direction of the first light exit opening, and wherein a second leg of the L-shaped cover part extends in the direction of the inner side of the luminaire body.

In an advantageous embodiment of the luminaire, it is provided that the first light source is configured in strip form, so that the first light source can be arranged particularly easily on the first leg or on the second leg of the cover part or in the edge region on the inner side of the luminaire body. A strip-shaped light source can be configured, for example, as an LED strip or as an LED band.

In order to be able to adapt a lighting situation to the required or desired lighting situation, it is provided that a light intensity of the first light beam bundle and a light intensity of the second light beam bundle can be adjusted independently of one another. As a result, particularly good direct lighting can be produced on the work surface with simultaneous superimposition of indirect lighting.

In order to be able to set further advantageous lighting situations, it is provided that a color temperature of the first light beam bundle and a color temperature of the second light beam bundle are adjustable independently of one another. For example, it is expedient that the first light source emits a warm, white light and the second light source emits a daylight white light with a higher color temperature. By superimposing the light beam bundles of both light sources in this way, the impression of sitting in the open air can be created. At the same time, the hard, warm light of the first light source at the workstation suggests sunshine-like illumination to the user. The diffuse, very cool white light reflected by the inner side of the luminaire body suggests a blue sky. It is also possible to adjust both the color temperatures and the luminous intensity of the light beam bundles of the light sources independently of one another.

The idea of the invention is explained below with reference to an exemplary embodiment shown in the drawings.

DETAILED DESCRIPTION

Figure 1:
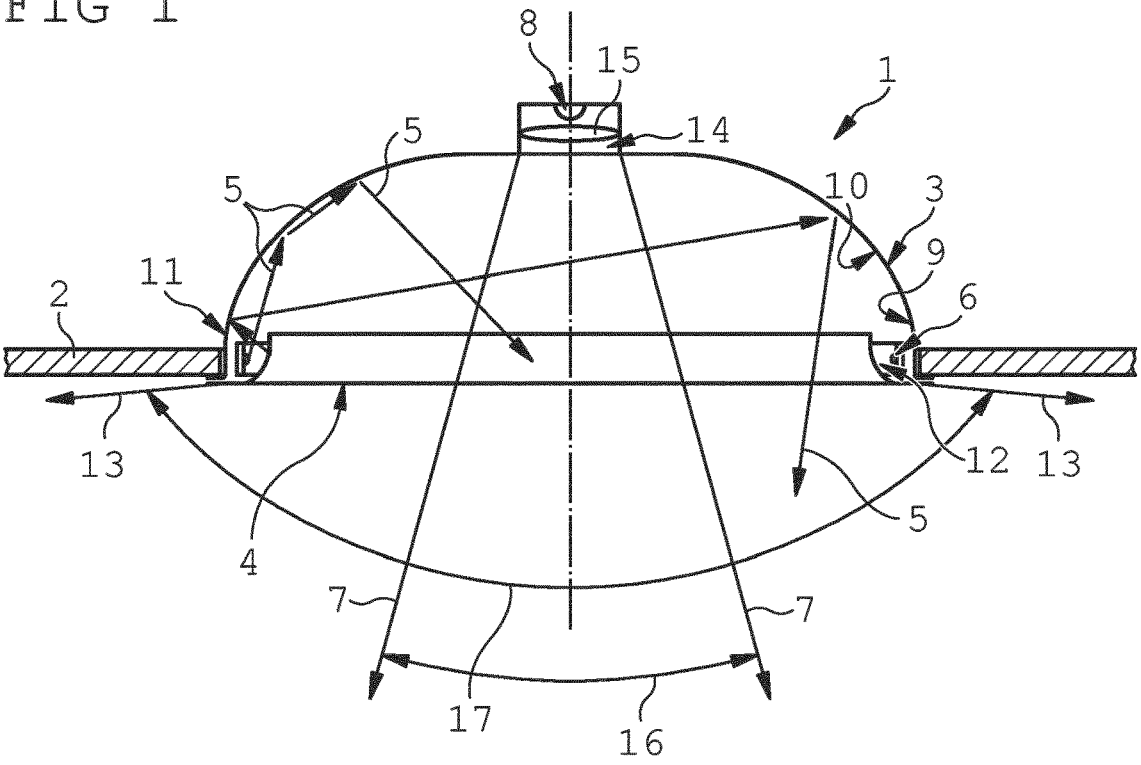
FIG. 1 is a schematic illustration of a luminaire in a sectional view.

In FIG. 1, a luminaire 1 is schematically shown in a sectional view as a luminaire 1 installed in a ceiling 2. The luminaire 1 serves to illuminate a work surface not shown in FIG. 1 by means of direct and indirect lighting components. The luminaire 1 comprises a half-shell-shaped luminaire body 3 with a first light exit opening 4, wherein a first light beam bundle 13, consisting of first light beams 5, of a first light source 6 and a second light beam bundle 7 of a second light source 8 pass through the first light exit opening 4. The luminaire body 3 comprises a first reflector portion 10 scatteringly reflecting on an inner side 9. The first light source 6 is configured as an LED strip and is arranged inside the luminaire body 3 in an edge portion 11 of the luminaire body 3. The luminaire body 3 also comprises a light-impermeable cover part 12 surrounding the first light exit opening 4. The cover part has an L-shaped configuration. A second reflector portion 12 is arranged between the first light source 6 and the first light exit opening 4. The first light beams 5 of the first light source 6 are at least partially deflected by the second reflector portion 12 in the direction of the first reflector portion 4. The deflected first light beams 5 are reflected at the first reflector portion 4 and exit the luminaire body 3 through the first light exit opening 4 as a first light beam bundle 13. A second light exit opening 14 of the second light source 8 is surrounded by the first reflector portion 10 at least in sections. The second light source 8 is arranged offset back behind the second light exit opening 14 opposite to a beam propagation direction of the second light beam bundle 7. The second light source 8 comprises a beam-shaping element 15 configured as a lens, with which the second light beam bundle 7 is focused. As a result, a second aperture angle 16 of the second light beam bundle 7 passing through the first light exit opening 4 and the second light exit opening 14 can be set smaller than a first aperture angle 17 of the first light beam bundle 5 passing through the first light exit opening 4.

Figure 2:
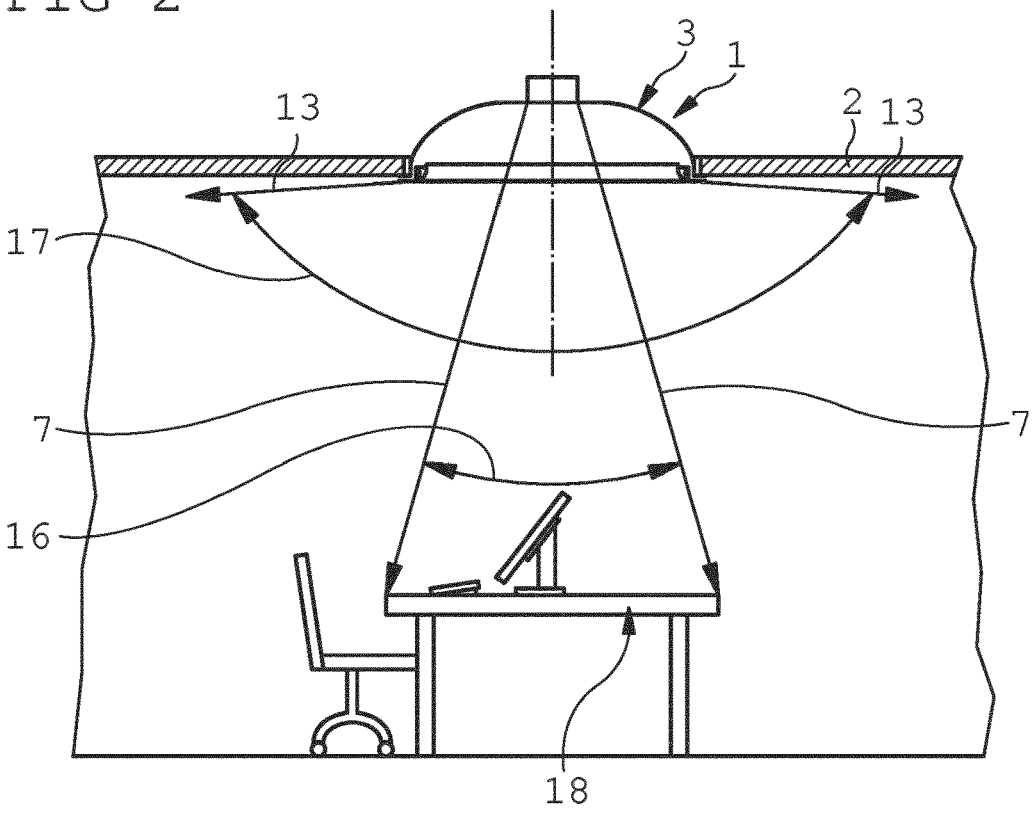
FIG. 2 is a schematic illustration of an illumination situation created by the luminaire.

In FIG. 2, an illumination situation created by the luminaire 1 is shown schematically. The luminaire 1 is arranged in the ceiling 2 of the room above a desk 18. The second light beam bundle 7 exiting the luminaire body 3 at the second aperture angle 16 produces direct illumination of a surface of the desk 18. The first light beam bundle 5 exiting the luminaire body 3 at the first aperture angle 17 is used for indirect illumination of the room and the desk 18.

The invention claimed is:

1. A luminaire (1), comprising a half-shell-shaped luminaire body (3), wherein the luminaire body (3) comprises a first light exit opening (4) for emitting light from at least two light sources (6, 8) of the luminaire (1), wherein the luminaire body (3) comprises, on an inner side (9), a diffusely-reflecting first reflector portion (10), wherein a first light source (6) is arranged within the luminaire body (3) in an edge portion (11) of the luminaire body (3) surrounding the first light exit opening (4), wherein first light beams (5) of the first light source (6) are deflected at least partially in a direction of the first reflector portion (10) by a second reflector portion (12) arranged within the luminaire body (3) and exit from the luminaire body (3) through the first light exit opening (4) as a first light beam bundle (13) diffusely-reflected at the first reflector portion (10), wherein a second light source (8) is arranged at least in sections within the luminaire body (3), wherein a second light beam bundle (7) directed in a direction of the first light exit opening (4) can be generated by the second light source (8), wherein the luminaire body (3) comprises, in the edge portion (11), a light-impermeable cover part surrounding the first light exit opening (4), wherein the second reflector portion (12) is arranged at least in sections on the cover part, wherein the cover part is configured in such a way that the first light beams (5) exit from the luminaire body (3) through the first light exit opening (4) exclusively as a first light beam bundle (13) reflected at the first reflector portion (10), and wherein the luminaire body (3) comprises a second light exit opening (14) which is surrounded at least in sections by the first reflector portion (10).

2. The luminaire (1) according to claim 1, wherein the second light beam bundle (7) is completely enclosed by the first light beam bundle (13) outside the luminaire body (3).

3. The luminaire (1) according to claim 1, wherein the second light beam bundle (7) generated by the second light source (8) is shaded at a circumferential edge of the second light exit opening (14).

4. The luminaire (1) according to claim 1, wherein the second light source (8) is arranged offset back behind the second light exit opening (14) opposite to a beam propagation direction of the second light beam bundle (7).

5. The luminaire (1) according to claim 1, wherein a diameter of the second light exit opening (14) is at most one fifth of a diameter of the first light exit opening (4).

6. The luminaire (1) according to claim 1, wherein the second light source (8) comprises a beam-shaping element (15) with which a second aperture angle (16) of the second light beam bundle (7) can be preset.

7. The luminaire (1) according to claim 6, wherein by the beam-shaping element (15), the second aperture angle (16) of the second light beam bundle (7) passing through the first light exit opening (4) and through the second light exit opening (14) can be set smaller than a first aperture angle (17) of the first light beam bundle (13) passing through the first light exit opening (4).

8. The luminaire (1) according to claim 1, wherein the cover part and the second reflector portion (12) are arranged at least in sections between the first light source (6) and the first light exit opening (4).

9. The luminaire (1) according to claim 1, wherein the second reflector portion (12) is arranged on a side of the cover part facing away from the first light exit opening (4) and facing the inner side (9) of the luminaire body (3).

10. The luminaire (1) according to claim 1, wherein the second reflector portion (12) completely surrounds the first light exit opening (4).

11. The luminaire (1) according to claim 1, wherein the luminaire body (3) is formed as a hemisphere.

12. The luminaire (1) according to claim 1, wherein the cover part is L-shaped, wherein a first leg of the L-shaped cover part adjoins an edge of the luminaire body (3) and extends in the direction of the first light exit opening (4), and wherein a second leg of the L-shaped cover part extends in a direction of the inner side (9) of the luminaire body (3).

13. The luminaire (1) according to claim 1, wherein the first light source (6) is configured in the form of a strip.

14. The luminaire (1) according to claim 1, wherein a light intensity of the first light beam bundle (13) and a light intensity of the second light beam bundle (7) are adjustable independently of one another.

15. The luminaire (1) according to claim 1, wherein a color temperature of the first light beam bundle (13) and a color temperature of the second light beam bundle (7) are adjustable independently of one another.

* * * * *